United States Patent [19]

Lynn

[11] Patent Number: 4,827,618

[45] Date of Patent: May 9, 1989

[54] CUE TIP SHAPER

[76] Inventor: Buddy E. Lynn, 4208 N. 35th, Tacoma, Wash. 98407

[21] Appl. No.: 198,433

[22] Filed: May 25, 1988

[51] Int. Cl.[4] ..... B27L 9/00

[52] U.S. Cl. ..... 30/374

[58] Field of Search ..... 30/494

[56] References Cited

U.S. PATENT DOCUMENTS 1,534,975 4/1925 Lindfors ..... 30/394

*Primary Examiner*—Frederick R. Schmidt
*Assistant Examiner*—Maurina Rachuba
*Attorney, Agent, or Firm*—Roy E. Mattern Jr.

[57] ABSTRACT

A finger held and/or hand held cue tip shaper has a body arranged as a substantially hollow cylinder having a larger outside diameter and larger inside diameter at one end, to receive a cue tip of larger diameter secured to the end of a larger diameter billiard or pool cure, and a smaller outside diameter and a smaller inside diameter at the other end, to receive a leather cue tip of smaller diameter secured to the end of a smaller diameter cure. A blade body with cutters at each end is located with one longitudinal side thereof located on the longitudinal centerline of the cue tip shaper, and in the central overall area thereof. During an injection molding process, the longitudinal upper and lower edges of the blade body become embedded in the injected molded plastics forming the body of the cue tip shaper. At one end of the blade body is a respective smaller concave cutter, and at the other end is a respective larger concave cutter. Each of these concave cutters commence at the centerline and then continue on just off of the longitudinal centerline. During a manufacturing operation, a group of blade bodies are held adjacent one another in a slanted position at a selected degree of bias, as a rotating preformed grinding wheel, advances horizontally to form the concave cutters, on this bias.

8 Claims, 2 Drawing Sheets

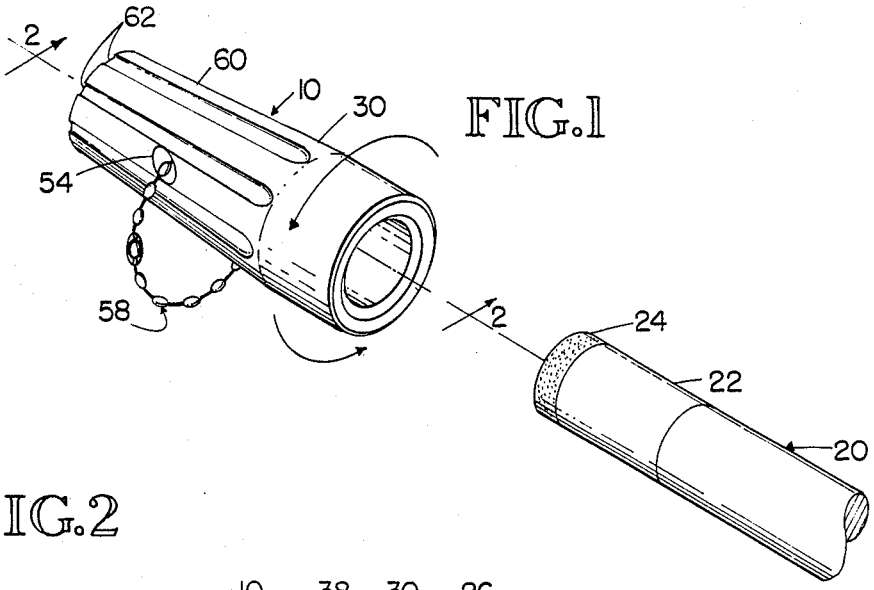
FIG. 1
FIG. 2
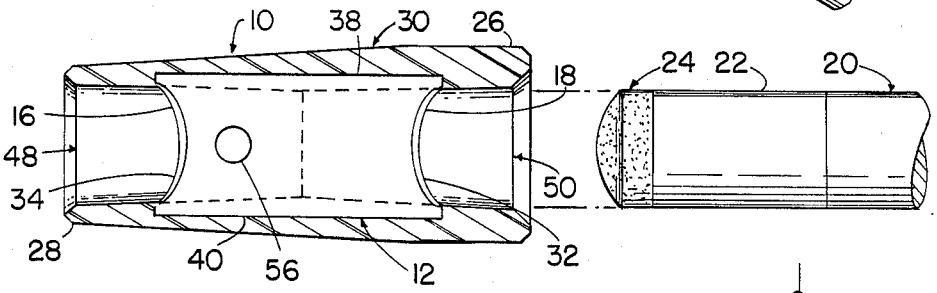
FIG. 3
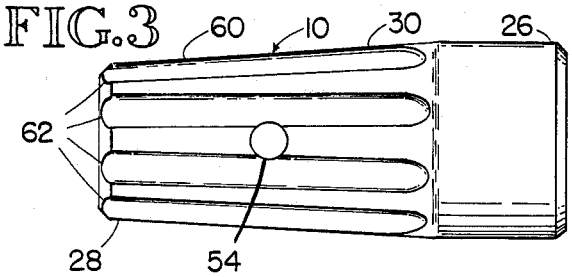
FIG. 4
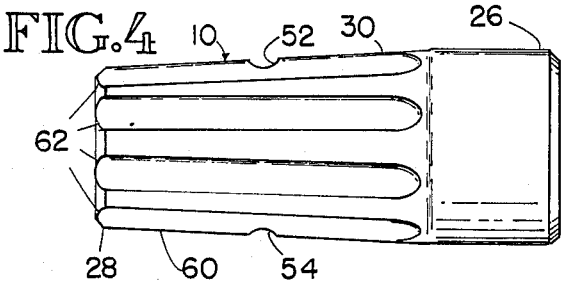
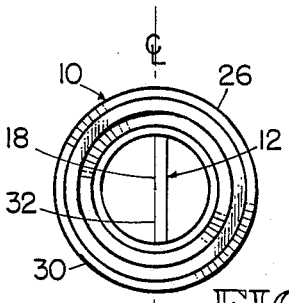
FIG. 5
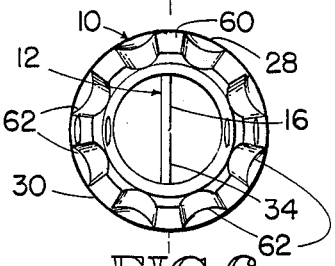
FIG. 6

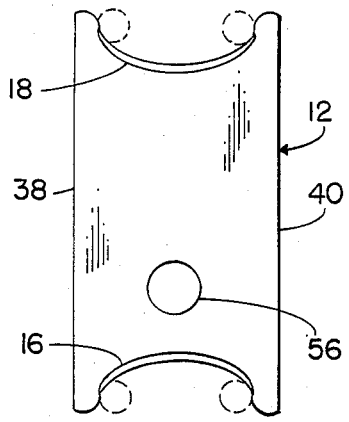
FIG7
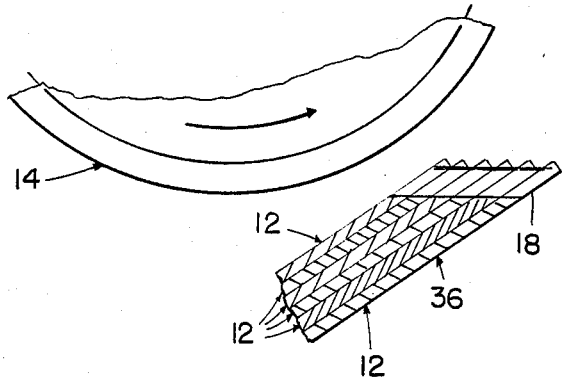
FIG.8
FIG.9
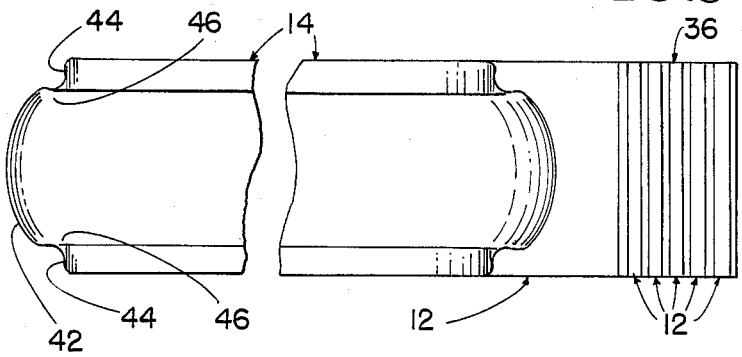

CUE TIP SHAPER

BACKGROUND

The players of pool and billiards periodically rework the leather ends of their cues, referred to as the leather cue tips. After making many shots the surface of the leather cue tip becomes too hard, and sometimes out of shape, and fails to properly receive the chalk deposits. In the past, persons have provided hand tools to be used in reworking these leather cue tips. For example:

Luther Johnson, H. W. Collender, and James E. Boyle, in their patent 94,317 of 1869 illustrated and described their machine, i.e. a hand held tool, used to trim cue leathers secured to the end of a cue. An adjustably positioned curved blade was set at a preselected cutting position at the end of a hollow wood holder or tube. The cue with its cue tip was inserted into the tube, until reaching a stop. Thereafter, while the hand held tool was so held by one hand the cue was rotated, by using one's other hand, until the cue tip was cut to the preferred contour;

George L. Rogers in his U.S. Pat. No. 1,259,136 of 1918 disclosed his assembly of components to be finger held over a leather cue tip and then rotated to cut the leather cue tip to a preset size and contour. A two part sleeve was provided, with one part having a receiving area to first receive a collar having internal longitudinal file like cutters designed to cut the circumference of a leather cue tip, and to then receive a concave disk having internal radial projecting teeth providing abrading surfaces used in shaping the end of the leather cue tip. After the placement of this collar and disk in the one part of the sleeve, the other sleeve part was threaded into the first sleeve part to hold all these components together, leaving an entry for the cue tip at one end, and a finger gripping portion at the other end. Upon the relative rotation of the assembled components and an inserted leather cue tip, the latter was formed for subsequently playing pool or billiards;

Victor E. Lindfors in his U.S. Pat. No. 1,534,975 of 1925 illustrated and described his cue tip scraper having a two piece body of longitudinal one half hollow sections which are assembled together as they surround and hold in place a mid positioned dual utter body having cutters facing each open end of the two piece body. Cue tip leathers on cues of smaller diameter sizes are entered into one end for forming upon relative motion, and cue tip leathers on cues of larger diameter sizes are entered into the other end for forming upon relative motion;

Harry Bozarth in his U.S. Pat. No. 2,577,995 of 1951 disclosed his cue tip trimmer, wherein a supporting body received a planer and its blade at a V-shaped slot of this supporting body. Thereafter a leather cue tip was rotated into selectable contact with the blade of the planer, while adjustably supported in the V-shaped slot during the rotation of the cue; and Bill A. Treadway in his U.S. Pat. No. 3,989,079 of 1976, illustrated and disclosed his cue tip dresser of comparatively small size to be held in a player's fingers and to be kept in a player's pocket for frequent use during a playing time. In one almost cube size embodiment a cavity was formed having a parabolic shape and thereafter the cavity surfaces were covered with an abrasive material. Subsequently, when a cue was arranged perpendicularly to the cube and the leather cue tip thereof was entered into the cavity and rotated, a conical end was formed. Or subsequently, when a cue was arranged at an angle to the cube and the leather cue tip was entered into the cavity and rotated a flatter cue tip end was formed.

SUMMARY

A cue tip shaper is provided to be held in a player's fingers and placed in alignment over the end of a cue tip and a cue tip end of a billiard or pool cue, and thereafter during relative motion the cue tip, generally made of leather, is contoured to create the best shape for the cue tip in respect to the size of the billiard or pool balls being used. Upon turning the cue tip shaper end for end, a cue tip on cue tip end of a different cue having a different diameter may be inserted. Thereafter upon relative rotation, a cue tip is reshaped to reach the best contour for this different diameter cue.

The cue tip shaper has a substantially round hollow body having a larger inside and larger outside diameter at one end to receive a cue tip of larger diameter secured to a cue of larger diameter, and having a smaller inside and smaller outside diameter at the other end to receive a cue tip of smaller diameter secured to a cue of smaller diameter.

In the general central area portion of the round hollow body is a planar blade body having cutting edges at each end thereof, and arranged longitudinally, so just one longitudinal side thereof is aligned on the centerline, to present a starting edge of each cutting edge at each end of the planar cutter body on the centerline, and then the balance of the respective cutting edges are located just off the longitudinal centerline. These cutting edges are concave in shape and formed on a selected degree of bias. The respective smaller and larger diameter concave cutters are used to form respective smaller and larger diameter cue tips. This planar blade body is initially positioned in an injection molding machine, among the manufacturing die components, and held by some of them, whereby, when the injected plastic flows into the cavities, it also flows about the top and bottom longitudinal edges of this planar blade body, as the surrounding substantially round hollow body is formed, completing the manufacture of the cue tip shaper In respect to the manufacture of the blade bodies with their cutting edges, a group of blade bodies are placed adjacent one another and as a group they are then placed in a slanted position, preferably at an overall selected degree of bias, and so held. Then a preformed grinding wheel, while rotating, is advanced horizontally to form the concave cutting edges, i.e. the cutters, on the like ends of all the blade bodies. These steps are repeated regarding the other end of the blade bodies, and a different sized preformed grinding wheel is used to create the different size cutting edges, i.e. the cutters, in respect to the like ends of all the blade bodies.

Preferably, the planar cutter body has a hole for positioning between holes that are formed in the round hollow body, when it is molded. Then through these three aligned holes a key chain is passed and releasibly secured to itself, to so serve as a key chain and/or a hanging chain.

DESCRIPTION OF THE DRAWINGS

A preferred embodiment of the cue tip shaper is shown in the drawings wherein:

FIG. 1 is a perspective view illustrating how the cue tip shaper is initially aligned with the leather cue tip on the end portion of the billiard cue, with the arrows indicating how the cue tip shaper will be subsequently rotated clockwise for a brief period of time, and then it will be rotated counterclockwise for a brief period of time, and then it will be rotated counterclockwise for a brief period of time, after the entry of the cue tip, during the recontouring of the cue tip material, and an optional key chain is shown;

FIG. 2 is a partial sectional side view, also illustrating how the cue tip shaper is initially aligned with the leather cue tip on the end portion of the billiard cue, and the cue tip shaper is shown in a sectional view taken along line 2—2 of FIG. 1 thereby showing the position of the blade body in the longitudinal central portion of the cue tip shaper, locating the cutters of different concave diameters, to respectively shape the cue tips of different diameter billiard cues, as the top and bottom edges of the blade body remain well embedded in plastic body of cue tip shaper;

FIG. 3 is a side view of the plastic body of the cue tip shaper, with the hole, matching the holes, shown in FIGS. 1, 2, and 4, which are all provided in alignment to optionally receive a key chain;

FIG. 4 is a top view of the plastic body of the cue tip shaper;

FIG. 5 is the end view of the larger end of the cue tip shaper, indicating how one longitudinal side of the blade body is located along the centerline;

FIG. 6 is the end view of the smaller end of the cue tip shaper, indicating how one longitudinal side of the blade body is located along the centerline;

FIG. 7 is a side view of only the blade body, illustrating how the cutting edges are principally formed using a larger radius, and then at their respective termini, they are formed using a very much smaller radius, as indicated by the dotted circles, drawn by using the much smaller radius, as indicated by the dotted circles, drawn by using the much smaller radius;

FIG. 8 is a partial schematic side view, illustrating how several blade bodies, during their production, are grouped together and placed at an angle, and thereafter a rotatable grinding wheel is rotated and moved to form the side by side cutting edges of the adjacent blade bodies; and FIG. 9 is a partial schematic top view further illustrating how the several blade bodies are grouped together and placed at an angle, as shown in FIG. 8, and thereafter a rotatable grinding wheel, pre-sized, to the respective larger radius, is rotated and moved to form the side by side cutting edges of the adjacent blade bodies, these grinding functions occurring with respect to both ends of the respective blade bodies.

DESCRIPTION OF THE PREFERRED EMBODIMENT

General Arrangement of the Cue Tip Shaper and How It Is Used

The finger held and/or hand held cue tip shaper 10 in a preferred embodiment is illustrated in the drawings, showing the final shape and arrangements thereof. Also shown is how the blade bodies 12 are ground by a preformed rotating grinding wheel 14 to form the different sized cutters, i.e. cutting edges 16, 18 of the blade body 12.

As shown in FIGS. 1 and 2, the pre-positioned approach of the cue tip shaper 10 is in axial alignment with the billiard cue 20 and the cue tip end 22 thereof, which supports the cue tip, 24, often made of leather. During the use of the cue tip shaper 10, the cue tip 24 on the billiard cue 20, is relatively rotated within a selected larger end 26, or within a selected smaller end 28, of a respective sized cue tip shaper 10, depending on a principal radius of the selected cutting edge 16 or 18, that is to be used in shaping the cue tip 24 to that same selected principal radius.

Each cue tip shaper 10 offers the selection of two sizes of cutting edges, and the selection of sizes per respective cue tip shapers 10, expressed in millimeters of billiard ball sizes is:

| Small End | Large End |
|---|---|
| 10 | 11 |
| 12 | 12.5 |
| 13 | 13.5 |
| 14 | 14.5 |

The Blade Body Location and the Making of the Cutting Edges Thereof

As shown in FIG. 2, the blade body 12 is located longitudinally in the central area between the large end 26 and small end 28 of the cue tip shaper body 30. As viewed in FIG. 5, the blade body 12 at the larger end 26 of the body 30, has the leading cutting edge 32 of the larger cutting edge 18 located on the vertical centerline of the cue tip shaper 10. Then the balance of the width of the blade body 12 appears to the right of the centerline. As viewed in FIG. 6, the blade body 12, at the smaller end 28 of the body 30, has the leading cutting edge 34 of the smaller cutting edge 16 located on the vertical centerline of the cue tip shaper 10. Then the balance of the width of the blade body 12 appears to the left of the centerline.

The arrangement of the cutting edge commencing at the centerline and then the balance being off center, makes it possible to guide the cue tip as the cutting occurs during the reshaping.

The blade body 12 is illustrated in FIGS. 2 and 7, as viewed from the side where the ground cutting edges 16 and 18 may be viewed. In reference to FIGS. 7, 8, and 9, the manufacture of this blade body 12, in reference to one specific size of a cutting edge, a preformed grinding wheel 14 has a major radius of 0.4175 inches across a width of 0.494 inches. At these width locations 0.494 inches apart, there are respective points of common tangency, where a minor radius of 0.050 inches is utilized to complete the preforming of this respective sized grinding wheel 14. The resulting location of the minor radius, in reference to the blade body 12 is illustrated by the dotted line circles in FIG. 7.

As viewed in FIG. 9 these respective major radii of 0.4175 inches at location 42, and minor radii of 0.050 inches at location 44, are used continuously in preforming the grinding wheels 14. However, to create different specified sizes of cutting edges 16, 18, the width dimensions are changed in respect to the transverse width of the grinding wheel portions at location 46.

As shown in FIGS. 8 and 9, a group 36 of blade bodies 12 are piled together on a horizontal surface and then tilted at a selected angle of bias, preferably in the range of forty to fifty degrees and held in place. Thereafter, the rotating preformed grinding wheel 14 is advanced horizontally to collectively form, during one operation, the specified size of a selected cutting edge 16 or 18 of one end of each blade body 12 in this group 36 of blade bodies 12, each one to be later incorporated into a selected size cue tip shaper 10.

As indicated in FIG. 2, the blade body 12, prior to the injection molding of a specific cue tip shaper body 30, is prepositioned within a die. Thereafter, during an injection molding manufacturing process, the flowing plastic forms about the upper longitudinal edge 38 and the lower longitudinal edge 40 of the blade body 12 to permanently embed and thereby to permanently locate the blade body 12 within the cue tip shaper body 30. A plastic material used is designated as an ABS plastic. Preferably, the gradual decrease in diameter of the outside surface of the cue tip shaper body 30 at the larger end 26, is at least the minimum release taper to accommodate injection molding procedures. The same is true for the release tapers of the inside surfaces of the respective smaller and larger entry are inserted to reach the respective cutters i.e. cutting edges 16, 18. The balance 60 of the outside surface of the cue tip shaper 10, may be formed with a greater decrease in diameter. The outside dimensions and the pleasing appearance thereof, remain the same for all cue tip shapers 10. The inside dimensions vary in respect to the matching of the different sizes of the cutters, i.e. cutting edges 16, 18.

The blade bodies 12 are made of steel, first formed by stamping operations, then heat treated to harden them and then ground to create the cutting edges, to thereby present long lasting cutting edges 16, 18 of each blade body 12 of each cue tip shaper 10.

Optional Desirable Features For Kev Chain and For Finger Gripping

The preferable size of the cue tip shaper 10 is two inches in length with a maximum diameter of three quarters of an inch. This size makes the cue tip shaper 10 conveniently carried in a pocket of a person's garment. Moreover, as illustrated in FIGS. 1, 2, 3, 4, and 7, aligned holes 52, 54 in the cue tip shaper body 30, and a hole 56 in the blade body 12, serve to receive a key chain 58, shown only in FIG. 1. When so equipped with a key chain 58, keys may be carried conveniently with the cue tip shaper 10. Moreover the cue tip shaper 10, with the key chain 58, and with or without any keys, may be hung from a hook for temporary storage of the cue tip shaper 10.

On the exterior surface of the cue tip shaper 10 in the portion 60 of a greater taper assisting a user in his or her finger contacts with the cue tip shaper 10. These grooves are arranged also for appearance and to reduce the quantity of plastic used in making the cue tip shaper 10. Also the larger and smaller ends are readily distinguishable upon gripping with one's fingers in a darkened room, so the larger and smaller cutter locations are readily found in their respective larger and smaller ends of the cue tip shaper.

The Reshaping of the Cue Tip on the Cue Tip End

As illustrated in FIGS. 1 and 2, the cue tip shaper 10 and the cue tip end 22, and therefore the billiard cue 20 or pool cue are preliminarily aligned. Thereafter, they are moved together, so the cue tip 24, often made of leather, are in light contact with one another, with the cue tip 24 bearing against a respective cutting edge 16 or 18. Subsequently relative rotation is undertaken in a clockwise direction for a short period and then reversed into a counterclockwise direction for a short period. The directional cycle may be repeated until the cue tip 24 is shaped again for accurately contacting the billiard ball or pool ball to improve the playing accuracy of a player. This reshaping of a cue tip 24 by the cue tip shaper 10 is readily undertaken, while a player is awaiting his turn during a game. When the cue tip 24 is being cut using this cue tip shaper 10, the cut tip 24 is also being fluffed. When the cue tip 24 is fluffed, it more readily holds the proper amount of chalk.

I claim:

1. A finger held cue tip shaper used in shaping and reshaping a cue tip on a cue used in playing billiards or pool, comprising:

(a) a body, which is substantially hollow cylinder having a larger outside diameter and a larger inside diameter at one end, to receive a cue tip of larger diameter secured to the end of a larger diameter cue, and a smaller outside diameter and a smaller inside diameter at the other end, to receive a cue tip of smaller diameter secured to the end of a smaller diameter cue; and (b) a blade body located longitudinally in the central area in the body, which is substantially a hollow cylinder, having at one end a larger concave cutter, and having at the other end a smaller concave cutter, and having one longitudinal side thereof positioned on the centerline of the body, which is substantially a hollow cylinder, thereby positioning the respective larger and smaller concave cutters, so an edge thereof of each concave cutter is at this centerline and the rest of the cutter is located just partially off this longitudinal centerline of the body, which is substantially a hollow cylinder.

2. A finger held cue tip shaper, as claimed in claim 1, wherein the concave cutters are in a bias position.

3. A finger held cue tip shaper, as claimed in claim 1, wherein the body which is substantially a hollow cylinder is made of plastic, and the blade body has upper and lower edges, which are embedded in the plastic of the blade body.

4. A finger held tip shaper, as claimed in claim 2 wherein the body which is substantially a hollow cylinder is made of plastic, and the blade body has upper and lower edges, which are embedded in the plastic of the blade body.

5. A finger held tip shaper, as claimed in claim 4, wherein the bias position of the concave cutters is at a selected angle in the preferable range of forty to fifty degrees.

6. A finger held tip shaper, as claimed in claim 5, wherein each concave cutter is formed along a principal larger radius and along another smaller radius on either side of the concave cutter, and these radii have a common point of tangency.

7. A finger held tip shaper, as claimed in claim 6, wherein each concave cutter having the two different radii and positioned on a selected angle of bias, preferably in the range of forty to fifty degrees, relative to the blade body, is formed by placing the blade body on the selected angle of bias, and then a rotating preformed grinding wheel is moved horizontally across the end of the blade body.

8. A finger held tip shaper as claimed in claim 7, wherein, during the forming of the concave cutter, several other blade bodies are placed adjacent to one another and held in their bias positions while the preformed grinding wheel is moved horizontally across the ends of the blade bodies.

* * * * *